US006746548B2

(12) United States Patent
Kusinski et al.

(10) Patent No.: US 6,746,548 B2
(45) Date of Patent: Jun. 8, 2004

(54) TRIPLE-PHASE NANO-COMPOSITE STEELS

(75) Inventors: Grzegorz J. Kusinski, Berkeley, CA (US); David Pollack, Tustin, CA (US); Gareth Thomas, Sonoma, CA (US)

(73) Assignee: MMFX Technologies Corporation, Irvine, CA (US)

( * ) Notice: Subject to any disclaimer, the term of this patent is extended or adjusted under 35 U.S.C. 154(b) by 0 days.

(21) Appl. No.: 10/017,847

(22) Filed: Dec. 14, 2001

(65) Prior Publication Data

US 2003/0111145 A1 Jun. 19, 2003

(51) Int. Cl.[7] ..... C22C 38/00
(52) U.S. Cl. ..... 148/320
(58) Field of Search ..... 148/320

(56) References Cited

U.S. PATENT DOCUMENTS

| | | | | |
|---|---|---|---|---|
| 4,170,497 A | | 10/1979 | Thomas et al. | |
| 4,170,499 A | | 10/1979 | Thomas et al. | |
| 4,581,202 A | * | 4/1986 | Kudo et al. | 419/42 |
| 4,619,714 A | | 10/1986 | Thomas et al. | |
| 4,671,827 A | | 6/1987 | Thomas et al. | |
| 6,066,212 A | * | 5/2000 | Koo et al. | 148/336 |
| 6,273,968 B1 | | 8/2001 | Thomas | |

FOREIGN PATENT DOCUMENTS

| | | |
|---|---|---|
| JP | 11-350064 | 12/1999 |
| JP | 11350064 A2 * | 12/1999 |
| WO | 00/37689 WO | 6/2000 |

OTHER PUBLICATIONS

Law et al. (Dept. Metall. Mater. Sci., Univ. Cambridge, Cambridge, UK). Crystallography of carbide precipitation on transformation of interfaces during austenite decomposition in a low alloy steel. Materials Science and Technology, 3 (8), 642–8, 1987.*

PCT International Search Report PCT/US02/40126, Mar. 3, 2003.

Law et al., *Materials Science and Technology*, 3:8: 642–648 (1987).

* cited by examiner

*Primary Examiner*—Deborah Yee
(74) *Attorney, Agent, or Firm*—M. Henry Heines; Townsend and Townsend and Crew LLP

(57) ABSTRACT

Carbon steels of high performance are disclosed that contain a three-phase microstructure consisting of grains of ferrite fused with grains that contain dislocated lath structures in which laths of martensite alternate with thin films of austenite. The microstructure can be formed by a unique method of austenization followed by multi-phase cooling in a manner that avoids bainite and pearlite formation and precipitation at phase interfaces. The desired microstructure can be obtained by casting, heat treatment, on-line rolling, forging, and other common metallurgical processing procedures, and yields superior combinations of mechanical and corrosion properties.

11 Claims, 5 Drawing Sheets

TRIPLE-PHASE NANO-COMPOSITE STEELS

BACKGROUND OF THE INVENTION

1. Field of the Invention

This invention resides in the field of steel alloys, particularly those of high strength, toughness, corrosion resistance, and cold formability, and also in the technology of the processing of steel alloys to form microstructures that provide the steel with particular physical and chemical properties.

2. Description of the Prior Art

Steel alloys of high strength and toughness and cold formability whose microstructures are composites of martensite and austenite phases are disclosed in the following United States patents, each of which is incorporated herein by reference in its entirety:

- U.S. Pat. No. 4,170,497 (Gareth Thomas and Bangaru V. N. Rao), issued Oct. 9, 1979 on an application filed Aug. 24, 1977
- U.S. Pat. No. 4,170,499 (Gareth Thomas and Bangaru V. N. Rao), issued Oct. 9, 1979 on an application filed Sep. 14, 1978 as a continuation-in-part of the above application filed on Aug. 24, 1977
- U.S. Pat. No. 4,619,714 (Gareth Thomas, Jae-Hwan Ahn, and Nack-Joon Kim), issued Oct. 28, 1986 on an application filed Nov. 29, 1984, as a continuation-in-part of an application filed on Aug. 6, 1984
- U.S. Pat. No. 4,671,827 (Gareth Thomas, Nack J. Kim, and Ramamoorthy Ramesh), issued Jun. 9, 1987 on an application filed on Oct. 11, 1985
- U.S. Pat. No. 6,273,968 B1 (Gareth Thomas), issued Aug. 14, 2001 on an application filed on Mar. 28, 2000

The microstructure plays a key role in establishing the properties of a particular steel alloy, and thus strength and toughness of the alloy depend not only on the selection and amounts of the alloying elements, but also on the crystalline phases present and their arrangement. Alloys intended for use in certain environments require higher strength and toughness, and in general a combination of properties that are often in conflict, since certain alloying elements that contribute to one property may detract from another.

The alloys disclosed in the patents listed above are carbon steel alloys that have microstructures consisting of laths of martensite alternating with thin films of austenite, and the alloys disclosed in U.S. Pat. No. 4,619,714 are low-carbon dual-phase steel alloys. In some of the alloys disclosed in these patents, the martensite is dispersed with fine grains of carbides produced by autotempering. The arrangement in which laths of one phase are separated by thin films of the other is referred to as a "dislocated lath" structure, and is formed by first heating the alloy into the austenite range, then cooling the alloy below a phase transition temperature into a range in which austenite transforms to martensite, accompanied by rolling or forging to achieve the desired shape of the product and to refine the alternating lath and thin film arrangement. This microstructure is preferable to the alternative of a twinned martensite structure, since the lath structure has greater toughness. The patents also disclose that excess carbon in the lath regions precipitates during the cooling process to form cementite (iron carbide, $Fe_3C$) by a phenomenon known as "autotempering." The '968 patent discloses that autotempering can be avoided by limiting the choice of the alloying elements such that the martensite start temperature $M_s$, which is the temperature at which the martensite phase first begins to form, is 350° C. or greater. In certain alloys, the autotempered carbides add to the toughness of the steel while in others the carbides limit the toughness.

The dislocated lath structure produces a high-strength steel that is both tough and ductile, qualities that are needed for resistance to crack propagation and for sufficient formability to permit the successful fabrication of engineering components from the steel. Controlling the martensite phase to achieve a dislocated lath structure rather than a twinned structure is one of the most effective means of achieving the necessary levels of strength and toughness, while the thin films of retained austenite contribute the qualities of ductility and formability. Obtaining such a dislocated lath microstructure rather than the less desirable twinned structure is achieved by a careful selection of the alloy composition, which in turn affects the value of $M_s$.

In certain applications, steel alloys are needed that maintain strength, ductility, toughness, and corrosion resistance over a very broad range of conditions, including very low temperatures. These and other matters in regard to the production of steel of high strength and toughness that is also resistant to corrosion are addressed by the present invention.

SUMMARY OF THE INVENTION

It has now been discovered that carbon steel alloys with a triple-phase crystal structure offer high performance and corrosion resistance over a broad range of conditions. The triple-phase crystal structure is a unique combination of ferrite, austenite, and martensite crystal phases in which crystals of ferrite are fused with crystals that contain the dislocated lath structure disclosed in the prior art patents referenced above, i.e., laths of martensite alternating with thin films of austenite. This triple-phase structure can be formed in various ways, extending over a wide range of compositions and formed by a variety of processing routes that include different types of casting, heat treatment, and rolling or forging. The alloy composition used in creating the triple-phase structure is one which has a martensite start temperature of about 300° C. or above, and preferably about 350° C. and above. This will ensure that a dislocated lath martensite structure will be included as part of the overall microstructure. To help achieve this, the carbon content is a maximum of 0.35% by weight.

The preferred method for forming the microstructure involves the metallurgical processing of a single carbon steel alloy composition by a process of staged cooling from an austenite phase. The first cooling stage of this method consists of a partial recrystallization of the austenite phase to precipitate ferrite crystals and thereby form a dual-phase crystal structure of austenite and ferrite crystals. The temperature reached in this first cooling stage determines the ratio of austenite to ferrite, as readily seen by the phase diagram of the particular alloy. Once this temperature is achieved, the steel is subjected to hot working to achieve further homogenization and reduction, as well as forming or shaping as desired, depending on the desired final product. Hot working may be performed by controlled rolling, such as for example for ultimate products that are rounds or flats, or by forging to produce distinct shapes, such as blades, agricultural implements, helmets, heli-seats, and the like. After hot working at this intermediate temperature, the second stage cooling occurs, in which the austenite phase is converted to the dislocated lath structure by converting the majority of the austenite to martensite while retaining a portion of the austenite as thin films that alternate with the laths of martensite. This second cooling stage is performed rapidly to prevent the formation of bainite and pearlite phases and interphase precipitates in general (i.e., precipitates along the boundaries separating adjacent phases). Minimum cooling rates in this regard may vary with differences in the alloy composition, but are readily discernible in general from transformation-temperature-time phase diagrams that exist for each alloy. An example of such a diagram is presented herein as FIG. 3 and discussed below.

The resulting triple-phase crystal structure provides a steel alloy that has superior properties over conventional steels in terms of stress-strain relationships, impact energy-temperature relationships, corrosion performance, and fatigue fracture toughness. These and other objects, features, and advantages of the invention will be better understood by the description that follows.

DESCRIPTION OF THE SPECIFIC EMBODIMENTS

Figure 1:
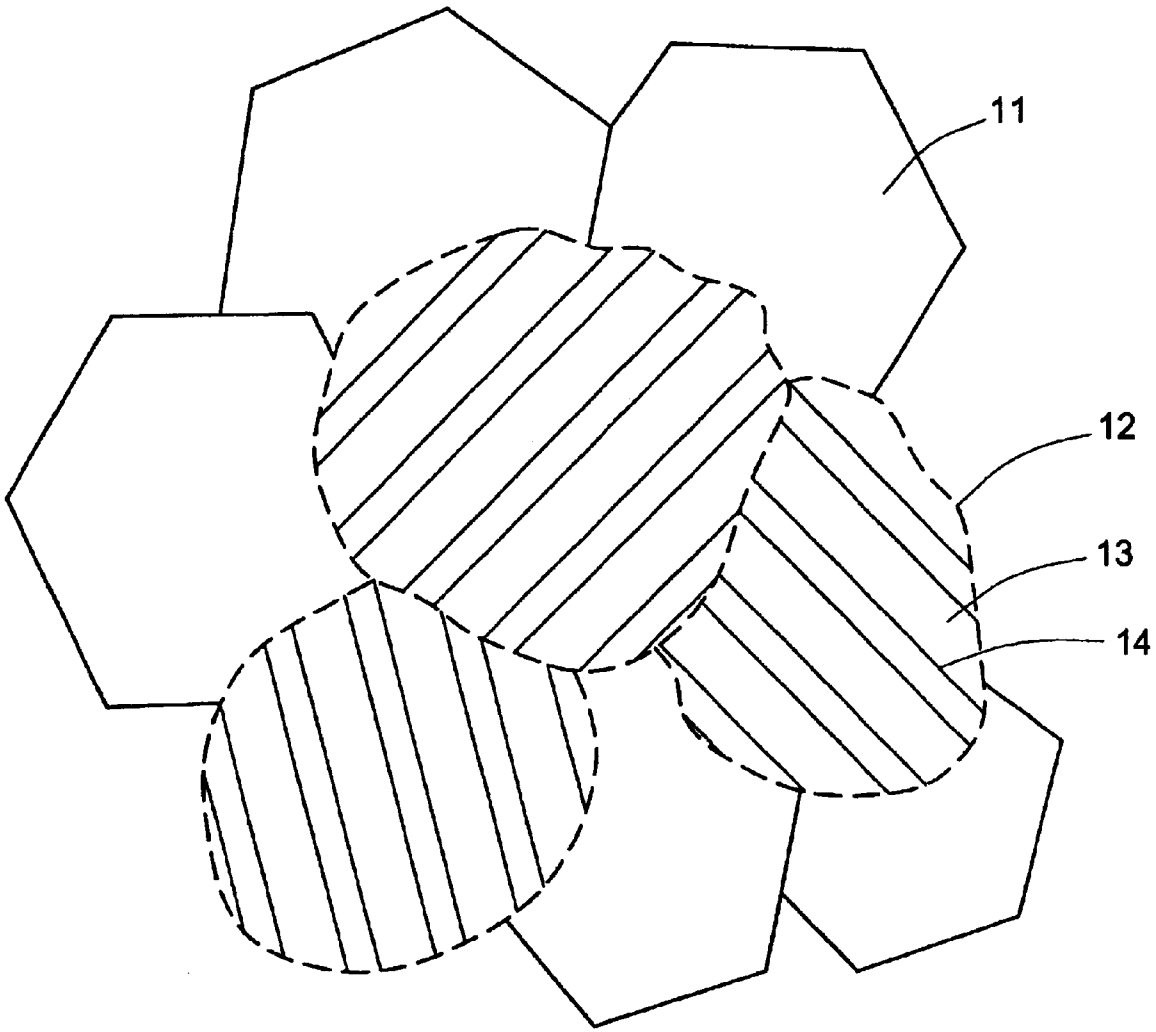
FIG. 1 is a sketch representing the microstructure of the alloys of the present invention.

The triple-phase crystal structure of this invention thus contains two types of grains—ferrite grains and martensite-austenite grains—fused together in a continuous mass in which the martensite-austenite grains contain martensite laths that have the dislocated lath structure. The individual grain size is not critical and can vary widely. For best results, the grain sizes will generally have diameters (or other appropriately characteristic linear dimension) that fall within the range of about 2 microns to about 100 microns, or preferably within the range of about 5 microns to about 30 microns. Within the martensite-austenite grains, the martensite laths are generally from about 0.01 micron to about 0.3 micron in width (adjacent laths separated by thin austenite films), and preferably from about 0.05 micron to about 0.2 micron. The amount of ferrite phase relative to the martensite-austenite phase may also vary widely and is not critical to the invention. In most cases, however, best results will be obtained when the martensite-austenite grains constitute from about 5% to about 95% of the triple-phase crystal structure, preferably from about 15% to about 60%, and most preferably from about 20% to about 40%, all by weight.

The carbon content of the alloy may vary as well within the limit of 0.35% maximum. In most cases, best results will be obtained with carbon levels ranging from about 0.01% to about 0.35%, preferably from about 0.03% to about 0.3%, and most preferably from about 0.05% to about 0.2%. As noted above, intra-lath carbide or carbonitride precipitates, i.e., precipitates located within the martensite laths rather than along the lath boundaries, may be present, whereas interphase precipitates (along the boundaries) is preferably avoided. Further alloying elements are also present in certain embodiments of the invention. One example is silicon, which in preferred embodiments constitutes from about 0.1% to about 3%, and preferably from about 1% to about 2.5%. Another example is chromium, which may be absent entirely (as in non-chromium Fe/Si/C steels) or when present may range from about 1% to about 13%, preferably from about 6% to about 12% by weight, and more preferably from about 8% to about 10%. Examples of other alloying elements included in various embodiments of the invention are manganese, nickel, cobalt, aluminum, and nitrogen, either singly or in combinations. Microalloying elements, such as molybdenum, niobium, titanium, and vanadium, may also be present. All percentages herein are by weight.

Preferred triple-phase crystal structures of this invention also contain substantially no carbides. As noted above, carbides and other precipitates are produced by autotempering. The effect that precipitates have on the toughness of the steel depends on the morphology of the precipitates in the steel microstructure. If the precipitates are located at the boundaries between phases, the result is a reduction in toughness and corrosion resistance. Precipitates located within the phases themselves are not detrimental to toughness, provided that the precipitates are about 500 Å or less in diameter. These intraphase precipitates may in fact enhance toughness. In general, however, precipitates can reduce corrosion resistance. Thus, in the preferred practice of this invention, autotempering can occur provided that precipitates do not form on the interfaces between the different crystal phases. The term "substantially no carbides" is used herein to indicate that if any carbides are in fact present, the amount is so small that the carbides have no deleterious effect on the performance characteristics, and particularly the corrosion characteristics, of the finished alloy.

The triple-phase alloys of this invention can be prepared by first combining the appropriate components needed to form an alloy of the desired composition, then homogenizing (i.e., "soaking") the composition by for a sufficient period of time and at a sufficient temperature to achieve a uniform austenitic structure with all elements and components in solid solution. The conditions for such homogenization will be readily apparent to those skilled in the art; a typical temperature range is 1050° C. to 1200° C. In accordance with practices well known in the art, the soaking is often followed by rolling to reductions of 10% or greater, and in many cases to a reduction of from about 30% to about 60%. This aids in the diffusion of the alloying elements to form a homogeneous austenite crystalline phase.

Once the austenite phase is formed, the alloy composition is cooled to a temperature in the intercritical region, which is defined as the region in which austenite and ferrite phases coexist at equilibrium. The cooling thus causes a portion of the austenite to recrystallize into ferrite grains, leaving the remainder as austenite. The relative amounts of each of the two phases at equilibrium varies with the temperature to which the composition is cooled in this stage, and also with the levels of the alloying elements. The distribution of the carbon between the two phases (again at equilibrium) also varies with the temperature. As noted above, the relative amounts of the two phases are not critical to the invention and can vary, with certain ranges being preferred. In terms of the temperature to which the austenite is cooled to achieve the dual-phase ferrite-austenite structure, a preferred temperature range is from about 750° C. to about 950° C., and a more preferred temperature range is from about 775° C. to about 900° C., depending on the alloy composition.

Once the dual-phase ferrite and austenite structures are formed (i.e., once equilibrium at the selected temperature in the intercritical phase is achieved), the alloy is rapidly quenched by cooling through the martensite transition range to convert the austenite crystals to the dislocated lath microstructure. The cooling rate is great enough to substantially avoid any changes to the ferrite phase. In addition, however, in preferred embodiments of the invention, the cooling rate is great enough to avoid the formation of bainite and pearlite, as well as nitride and carbonitride precipitates, depending on the alloy composition, and also the formation of any precipitates along the phase boundaries. The terms "interphase precipitation" and "interphase precipitates" are used herein to denote precipitation along phase boundaries and refers to the formation of small deposits of compounds at locations between the martensite and austenite phases, i.e., between the laths and the thin films separating the laths. "Interphase precipitates" does not refer to the austenite films themselves. The formation of all of these various types of precipitates, including bainite, pearlite, nitride, and carbonitride precipitates, as well as interphase precipitates, is collectively referred to herein as "autotempering." The minimum cooling rate needed to avoid autotempering is evident from the transformation-temperature-time diagram for the alloy. The vertical axis of the diagram represents temperature and the horizontal axis represents time, and curves on the diagram indicate the regions where each phase exists either by itself or in combination with another phase(s). A typical such diagram is shown in Thomas, U.S. Pat. No. 6,273,968 B1, referenced above, and another is included herewith as FIG. 3, discussed below. In such diagrams, the minimum cooling rate is a diagonal line of descending temperature over time which abuts the left side of a C-shaped curve. The region to the right of the curve represents the presence of carbides, and acceptable cooling rates are therefore those represented by lines that remain to the left of the curve, the slowest of which has the smallest slope and abuts the curve.

Depending on the alloy composition, a cooling rate that is sufficiently great to meet this requirement may be one that requires water cooling or one that can be achieved with air cooling. In general, if the levels of certain alloying elements in an alloy composition that is air-coolable and still has a sufficiently high cooling rate are lowered, it will be necessary to raise the levels of other alloying elements to retain the ability to use air cooling. For example, the lowering of one or more of such alloying elements as carbon, chromium, or silicon may be compensated for by raising the level of an element such as manganese.

Preferred alloy compositions for the purposes of this invention are those that contain from about 0.05% to about 0.1% carbon, from about 0.3% to about 5% nickel, and approximately 2% silicon, all by weight, the remainder being iron. The nickel can be replaced by manganese at a concentration of at least about 0.5%, preferably 1–2% (by weight), or both can be present. The preferred quenching method is by water cooling. Preferred alloy compositions are also those that have a martensite start temperature of about 300° C. or higher.

The processing procedures and conditions set forth in the U.S. patents referenced above, particularly heat treatments, grain refinements, on-line forgings and the use of rolling mills for rounds, flats, and other shapes, may be used in the practice of the present invention for the heating of the alloy composition to the austenite phase, the cooling of the alloy from the austenite phase to the intercritical phase, and then the cooling through the martensite transition region. Rolling is performed in a controlled manner at one or more stages during the austenitization and first-stage cooling procedures, for example, to aid in the diffusion of the alloying elements to form a homogeneous austenite crystalline phase and then to deform the crystal grains and store strain energy in the grains, while in the second-stage cooling, rolling can serve to guide the newly forming martensite phase into a dislocated lath arrangement of martensite laths separated by thin films of retained austenite. The degree of rolling reductions can vary, and will be readily apparent to those skilled in the art. In the martensite-austenite dislocated lath crystals, the retained austenite films will constitute from about 0.5% to about 15% by volume of the microstructure, preferably from about 3% to about 10%, and most preferably a maximum of about 5%. The proportion of austenite relative to the entire triple-phase microstructure will be a maximum of about 5%. The actual width of a single retained austenite film is preferably within the range of about 50 Å to about 250 Å, and preferably about 100 Å. The proportion of austenite relative to the entire triple-phase microstructure will in general be a maximum of about 5%.

FIG. 1 is a sketch of the triple-phase crystal structure of this invention. The structure includes ferrite grains 11 fused with martensite-austenite grains 12, and each of the martensite-austenite grains 12 is of the dislocated lath structure, with substantially parallel laths 13 consisting of grains of martensite-phase crystals, the laths separated by thin films 14 of retained austenite phase.

Figure 2:
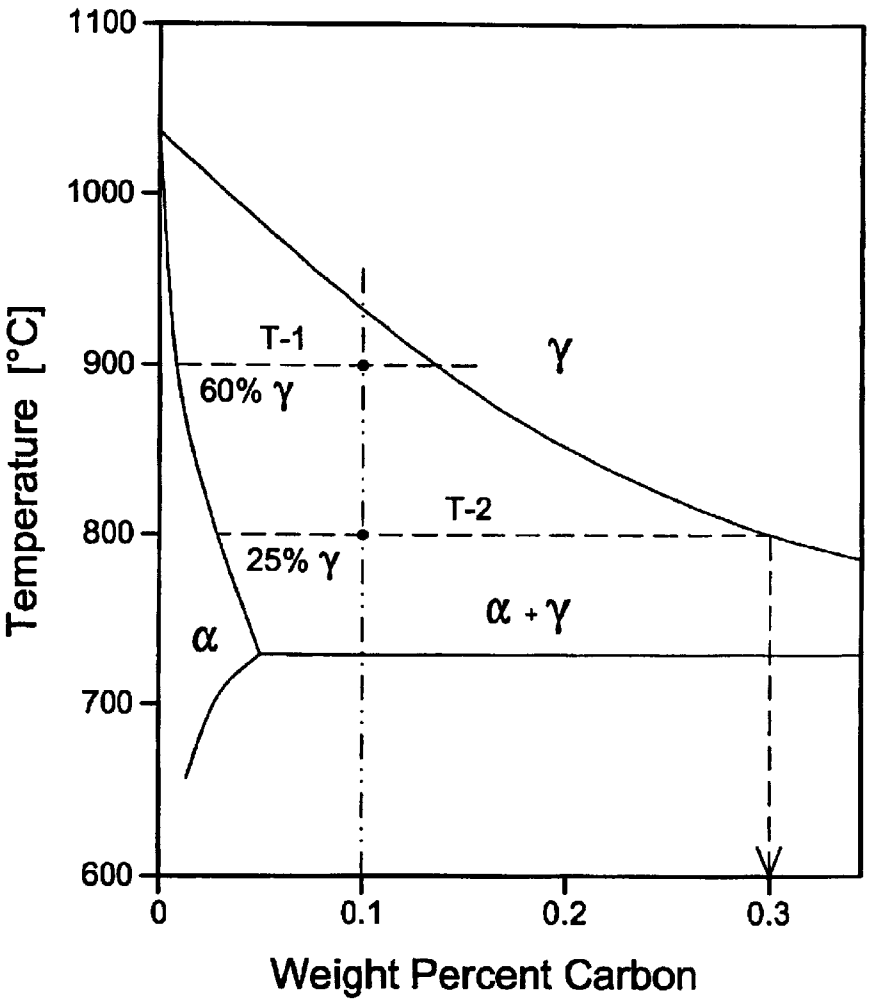
FIG. 2 is a phase diagram showing the different crystalline phases that are present at different temperatures and carbon contents for a particular carbon steel alloy of the present invention.

FIG. 2 is a phase diagram for a class of carbon steels indicating the transformations that occur during the cooling stages and the effects of different concentrations of carbon. This particular phase diagram represents carbon steels that contain 2% silicon. The region to the right of the upper curve is marked "γ" which represents the austenite phase; all other regions contain "α" which represents the ferrite phase. In the austenitization stage, the alloy is heated to the all-γ region at the upper right. The vertical dashed line at 0.1% carbon indicates the phases that occur when cooling an 0.1% carbon steel alloy (containing 2% silicon) from the austenite phase. If cooling stops at 900° C. ("T-1"), the carbon concentrations in the two phases will be those indicated by the intersections of the T-1 line with the two curves. In the case shown in FIG. 2, the carbon contents of the two phases upon cooling to T-1 is approximately 0.001% C in the ferrite phase and 0.14% in the austenite phase. The proportion of the phases is also established by the selected temperature. While this is not discernable from the phase diagram, the proportion will be susceptible to determination by those skilled in the art. In the case shown in FIG. 2, the proportion achieved at T-1 is 60% austenite and 40% ferrite. If the steel is cooled to 800° C. ("T-2"), the carbon concentrations in the two phases will be those indicated by the intersections of the T-2 line with the two curves, which are different from those corresponding to 900° C., and the proportion of the phases will likewise differ. In this case, the carbon levels of the two phases will be approximately 0.03% in the ferrite phase and 0.3% in the austenite phase. The relative amounts of the two phases will be approximately 25% austenite and 75% ferrite. The proportion is thus selected by selecting the temperature to which the first stage cooling occurs and maintaining the $M_s$ temperature of the austenite above 300° C.

Once the first-stage cooling is completed, the steel is subjected to controlled rolling by methods well known in the art control the grain size as well as to shape and form the steel for its ultimate use.

Figure 3:
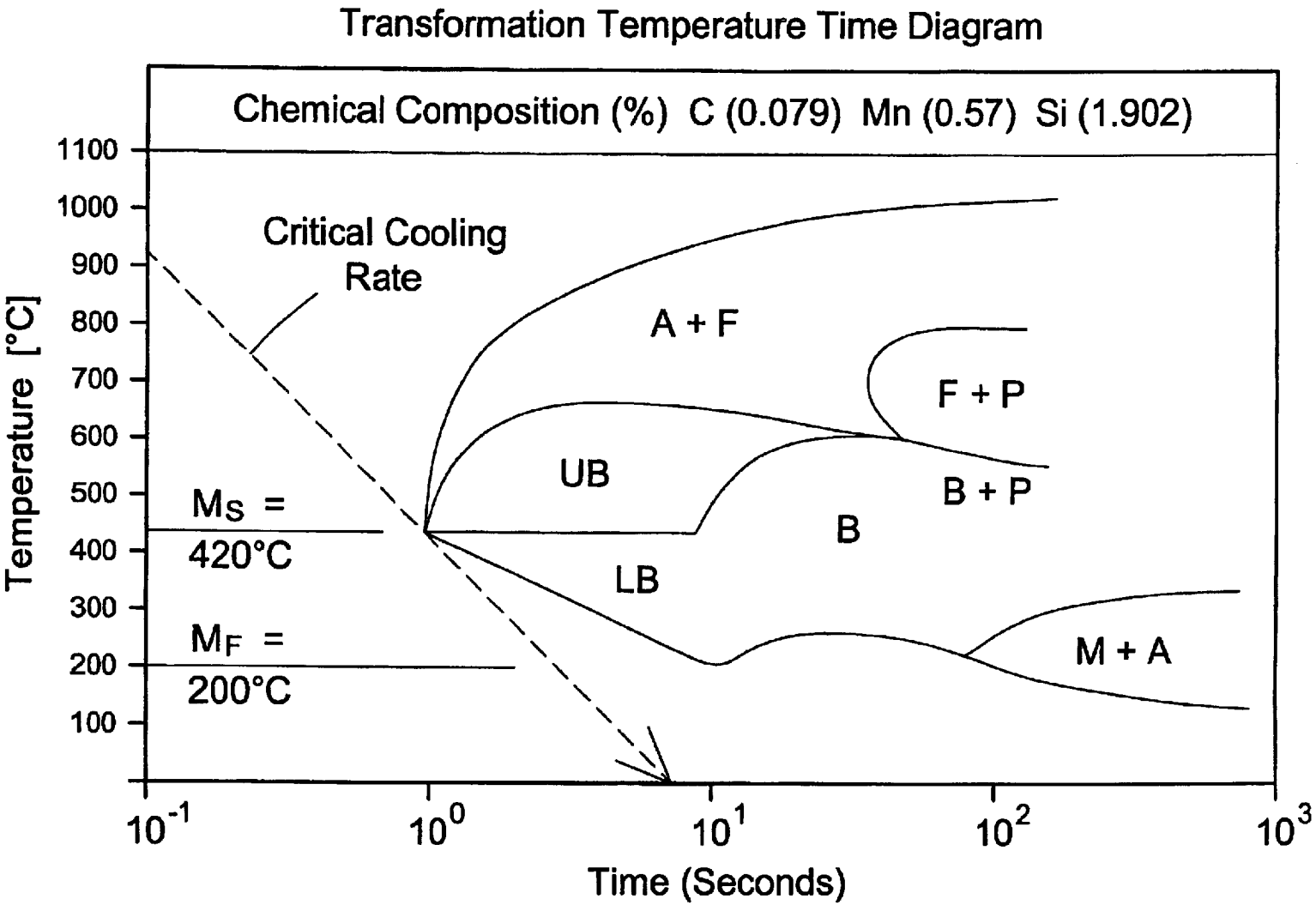
FIG. 3 is a kinetic transformation-temperature-time diagram demonstrating the process procedures and conditions of the second-stage cooling of this invention for a particular Fe/Si/C steel of this invention.

The second-stage cooling is then performed, causing the formation of the martensite phase in a dislocated lath arrangement. As noted above, this is performed at a rate fast enough to prevent both bainite and pearlite formation as well as the formation of any interphase precipitates. FIG. 3 is a kinetic transformation-temperature-time diagram representing the second-stage cooling for an alloy containing 0.079% C, 0.57% Mn, and 1.902% Si. The following symbols are used:

"A": austenite

"M": martensite

"F": ferrite

"B": bainite

"UB": upper bainite

"LB": lower bainite

"P": pearlite

"$M_s$": martensite start temperature (420° C.)

"$M_f$": martensite finish temperature (200° C.)

The slanted dashed line in FIG. 3 indicates the slowest cooling rate that will avoid the formation of bainite or pearlite and interphase precipitates in general, and therefore that rate or any cooling rate that is represented by a steeper line can be used.

Figure 4:
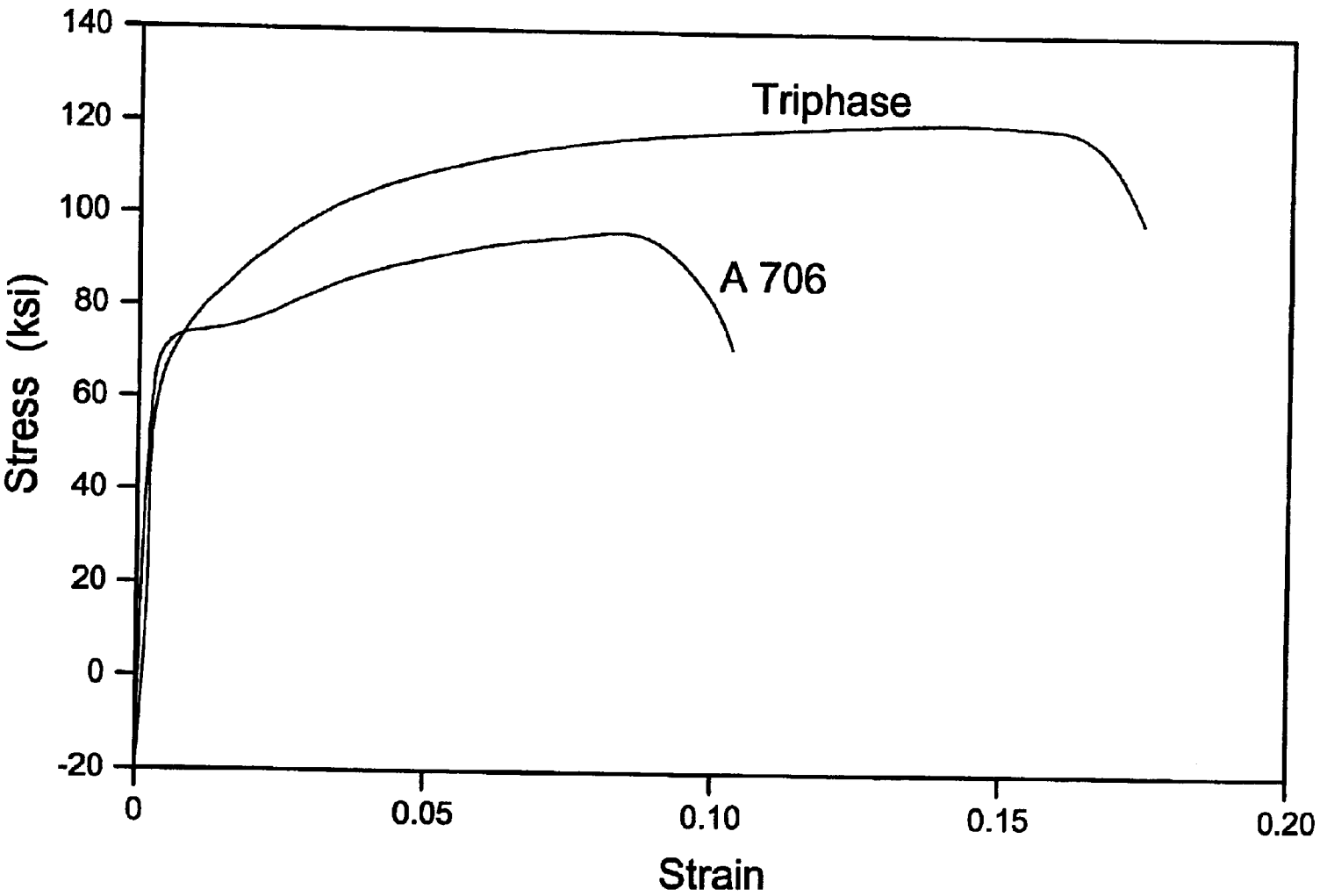
FIG. 4 is a plot of stress vs. strain curves comparing an alloy of the present invention and AISI Steel A706 of the prior art.

FIG. 4 is a plot of stress vs. strain, comparing a carbon steel alloy of triple-phase crystal structure of the present invention in which the martensite-austenite phase constitutes 40% of the entire microstructure and the inter-lath austenite constitutes 2% of the entire microstructure, with a conventional AISI A706 steel alloy. The ratio of tensile strength to yield strength is greater than 1.5, and the plot shows the superiority of the alloy of the invention.

Figure 5:
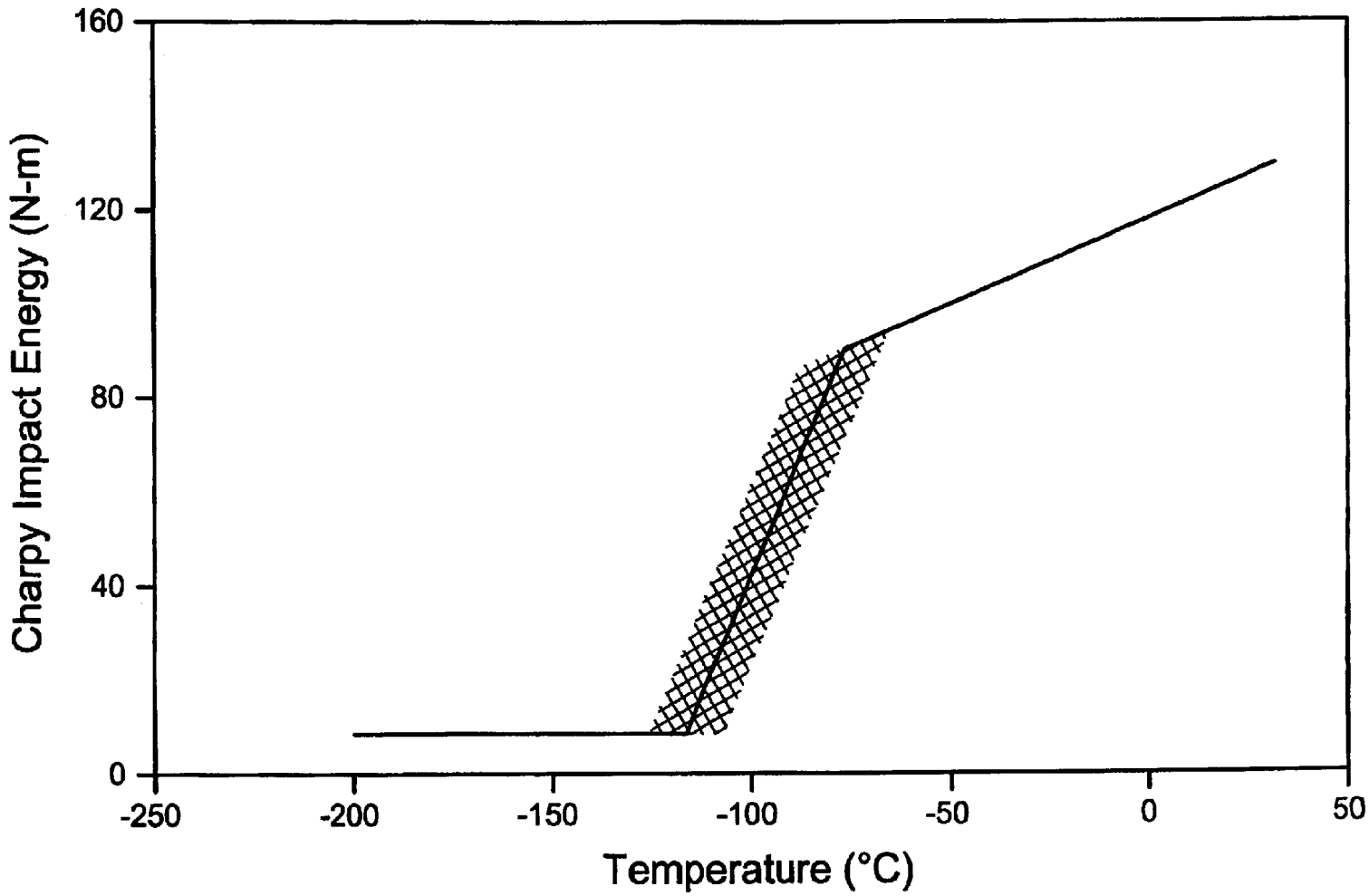
FIG. 5 is a plot of Charpy impact energy vs. temperature for an alloy of the present invention, showing exceptional low-temperature toughness.

FIG. 5 is a plot of the Charpy impact energy vs. temperature for the same carbon steel alloy of the present invention shown in FIG. 4.

The steel alloys of this invention are particularly useful in products that require high tensile strengths, notably those used in saline/marine environments.

The foregoing is offered primarily for purposes of illustration. Further modifications and variations of the various parameters of the alloy composition and the processing procedures and conditions may be made that still embody the basic and novel concepts of this invention. These will readily occur to those skilled in the art and are included within the scope of this invention.

What is claimed is:

1. An alloy carbon steel comprising iron and a maximum of 0.35% by weight of carbon, said alloy carbon steel having a triple-phase microstructure comprising ferrite crystals fused with martensite-austenite crystals, said crystals having grain sizes within the range of about 2 microns to about 100 microns, said martensite-austenite crystals comprising laths of martensite alternating with thin films of austenite, said martensite-austenite crystals constituting from about 5% to about 95% by weight of said triple-phase microstructure, and said martensite-austenite crystals devoid of carbide precipitates at interfaces between phases.

2. An alloy carbon steel in accordance with claim 1 in which said martensite-austenite crystals constitute from about 15% to about 60% by weight of said triple-phase microstructure.

3. An alloy carbon steel in accordance with claim 1 in which said martensite-austenite crystals constitute from about 20% to about 40% by weight of said triple-phase microstructure.

4. An alloy carbon steel in accordance with claim 1 in which said carbon constitutes from about 0.01% to about 0.35% by weight of said triple-phase microstructure.

5. An alloy carbon steel in accordance with claim 1 in which said carbon constitutes from about 0.03% to about 0.3% by weight of said triple-phase microstructure.

6. An alloy carbon steel in accordance with claim 1 in which said carbon constitutes from about 0.05% to about 0.2% by weight of said triple-phase microstructure.

7. An alloy carbon steel in accordance with claim 1 further comprising silicon at a concentration of from about 0.1% to about 3% by weight of said alloy composition.

8. An alloy carbon steel in accordance with claim 1 further comprising silicon at a concentration of from about 1% to about 2.5% by weight of said alloy composition.

9. An alloy carbon steel in accordance with claim 1 in which said carbon constitutes from about 0.03% to about 0.3% by weight of said triple-phase microstructure, said alloy carbon steel further comprising silicon at a concentration of from about 0.1% to about 3% by weight of said alloy composition.

10. An alloy carbon steel in accordance with claim 1 in which said carbon constitutes from about 0.05% to about 0.2% by weight of said triple-phase microstructure, said alloy carbon steel further comprising silicon at a concentration of from about 1% to about 2.5% by weight of said alloy composition, and containing substantially no carbides.

11. An alloy carbon steel in accordance with claim 1 in which grain sizes are within the range of about 5 microns to about 30 microns.

* * * * *